United States Patent [19]

Pinnow

[11] Patent Number: 4,942,747

[45] Date of Patent: Jul. 24, 1990

[54] OPERATOR LOCKOUT PREVENTION DEVICE

[75] Inventor: Douglas A. Pinnow, Laguna Hills, Calif.

[73] Assignee: Universal Photonix, Inc., Laguna Hills, Calif.

[21] Appl. No.: 257,551

[22] Filed: Oct. 14, 1988

[51] Int. Cl.[5] ..... E05B 47/00

[52] U.S. Cl. ..... 70/263; 70/277

[58] Field of Search ..... 70/263, 264, 27714 278, 70/237; 340/457; 180/286, 289

[56] References Cited

U.S. PATENT DOCUMENTS 4,789,851 12/1988 Hock ..... 340/457

*Primary Examiner*—Robert L. Wolfe

*Attorney, Agent, or Firm*—Bacon & Thomas

[57] ABSTRACT

A device for preventing an operator of a vehicle from locking an ignition key in the vehicle includes a key-in-ignition sensor switch, an open-door sensor switch, and a power door lock sensor switch. A logic circuit outputs a pulse to activate a power door unlocking circuit and an audible alarm whenever the three sensor switches indicate that the key is in the ignition, the door is open, and the power door lock switch has been pressed.

10 Claims, 4 Drawing Sheets

OPERATOR LOCKOUT PREVENTION DEVICE

BACKGROUND OF THE INVENTION

1. Field of the Invention

This invention relates to security systems and to power door lock systems for motor vehicles, and more specifically to a device for preventing an operator of the vehicle from locking an ignition key in the vehicle when the key is left in the ignition.

2. Description of the Related Art

Systems which provide an audible warning when a motor vehicle door is open and an ignition key is left in the ignition are well-known. However, because such conventional key-in-ignition warning systems do not prevent an inattentive operator from locking the ignition key in his or her vehicle despite the warning, attempts have been made to provide a system which not only warns the operator, but also prevents the door from locking whenever an attempt is made to leave the vehicle with the key in the ignition.

An example of a system which prevents the operator from locking the vehicle when a key is in the ignition is described in U.S. Pat. No. 4,709,777 to Metz. A key-in-ignition sensor switch and a door-open sensor switch are each connected to a logic circuit which outputs an electrical signal when the key-in-ignition sensor switch and door-open sensor switch indicate simultaneous key-in-ignition and door-open conditions. An open door generally indicates that the operator is attempting to leave the motor vehicle.

The signal output by the logic circuit opens a relay which in turn opens a lock circuit connected to a power door lock/unlock mechanism. The lock circuit normally actuates a solenoid or motor for locking the door when a lock switch is manually pressed. However, when the logic circuit signal is output in response to simultaneous door-open and key-in-ignition conditions, the open relay prevents actuation of the locking motor or solenoid and instead closes an alarm circuit for activating an audible alarm, for example, the vehicle's horn or a buzzer. Thus, locking of the door is prevented whenever the key-in-ignition and door-open conditions are met.

A similar type of door locking prevention system is disclosed in U.S. Pat. No. 4,223,296 to Kim et al. Again, a door-open sensor switch and a key-in-ignition sensor switch are electrically connected to output a signal indicative of a simultaneous key-in-ignition and door-open condition, but instead of a relay for opening the door lock circuit, the system described by Kim et al. requires a soleniod which physically prevents the power door lock switch from moving to close the locking circuit, thereby preventing the door from locking.

Finally, U.S. Pat. No. 4,572,320 to Robbins discloses a third type of system which, unlike the other two types of systems, allows the door to be locked but subsequently unlocks it. A key-in-ignition and a door-open switch are again provided, but both switches are connected in series with a third switch for sensing locking of the door. The third switch is a contact-type switch closed by movement of the manual door lock switch. When all three switches are closed, the third switch indicating that the door has been locked, a solenoid is activated to physically move the manual power door lock switch to a position at which it closes an unlocking circuit for unlocking the door.

While each of the above-described systems appears to be relatively effective in preventing operator lock-outs, their application is limited because of the high cost of providing the additional relays, solenoids, and other mechanical parts required to implement the systems, and because each system requires substantial modification of existing power door lock circuits in order to control and provide power to the additional electro-mechanical parts.

SUMMARY OF THE INVENTION

The present invention provides an operator lockout prevention mechanism which does not require significant modification of existing power door lock systems. Rather than preventing the operator from locking the door upon attempting to leave the vehicle when the key is in the ignition, the circuits of this invention permit the door to be locked. Immediately after locking, however, the existing unlocking mechanism is activated by a simple logic circuit to unlock the door upon sensing that the key is in the ignition and the door is open. In a preferred embodiment, the operator lockout prevention controller of this invention may use a single AND gate and logic element, e.g., a flip-flop or one shot timer, requiring no additional relays or other electro-mechanical parts. Furthermore, the system of the invention can be incorporated into an existing computerized vehicle security or central control system by simply modifying the central computer control program.

DETAILED DESCRIPTION OF THE PREFERRED EMBODIMENTS

Figure 1:
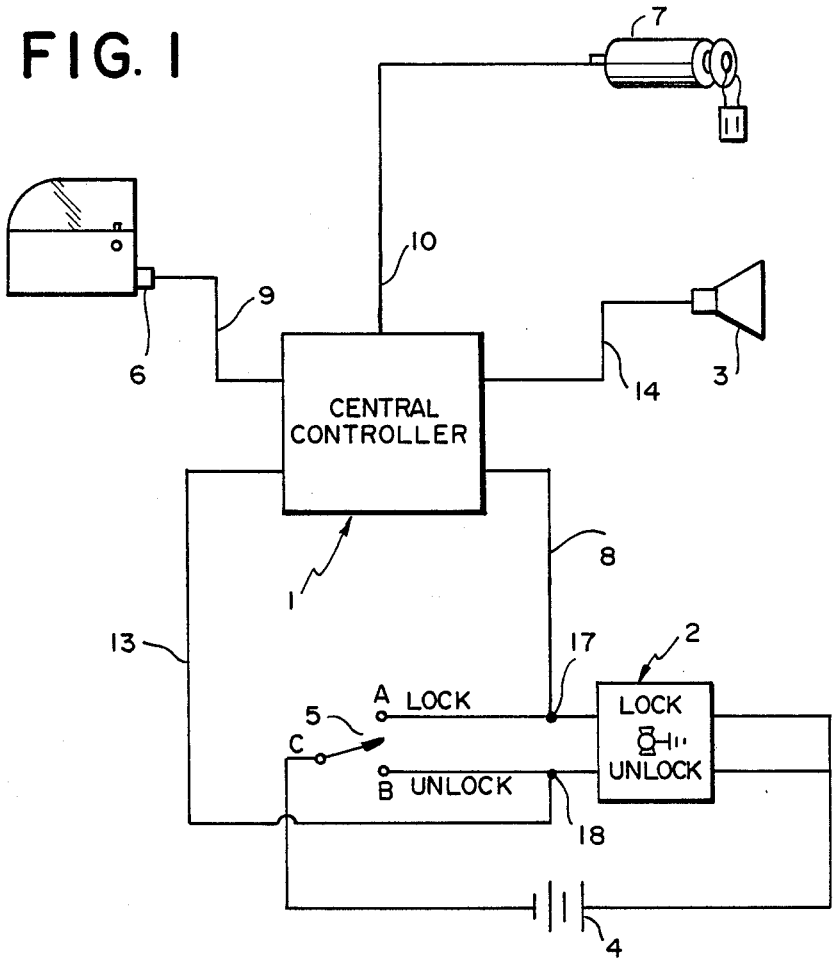
FIG. 1 shows a schematic view of a preferred embodiment of the present invention.

Referring to FIG. 1, an exemplary operator lockout prevention system for a motor vehicle includes a central controller 1, a power door lock mechanism 2, an audible alarm 3, a door lock switch 5, an open door sensor 6, and a key-in-ignition sensor 7. The central controller 1 is connected to each of elements 2, 3, and 5–7 by electric signal carrying lines 8–14. Sensors 6 and 7 may be conventional contact-type switches, but it is also possible, for example, to use an optical key sensor, as disclosed in my co-pending U.S. Pat. No. 4,068,559.

The power door lock mechanism 2 includes a reversible motor or a solenoid for driving the door locking members (not shown). The mechanism automatically locks the doors of the vehicle in response to door lock switch 5 located inside the vehicle, the switch completing either a door locking circuit or a door-unlocking circuit connected to the power door lock mechanism. The switch may be manually or remotely actuated and may control any or all doors of the vehicle.

The door locking circuit includes terminal A of switch 5, controls the power door lock solenoid or motor of power door lock mechanism 2, and includes a power supply 4 and terminal C of switch 5. The door-unlocking circuit includes terminal B of switch 5, also runs through the power door lock mechanism to cause the motor or solenoid to reverse direction for unlocking the door, and is also connected to power supply 4 and terminal C of switch 5.

An electric signal line 8 connects the central controller 1 to the locking circuit at junction 17, and a signal line 13 connects the central controller 1 to the unlocking circuit at junction 18. As a result, the power door lock mechanism 2 can be activated to unlock the door by either switch 5 or by a signal from controller 1, and the door locking signal resulting from movement of switch 5 to terminal A, completing the locking circuit, is also sensed by the central controller through line 8. Suitable ground terminals are, of course, provided in connection with the mechanism 2 and controller 1 to complete the respective circuits.

Figure 2:
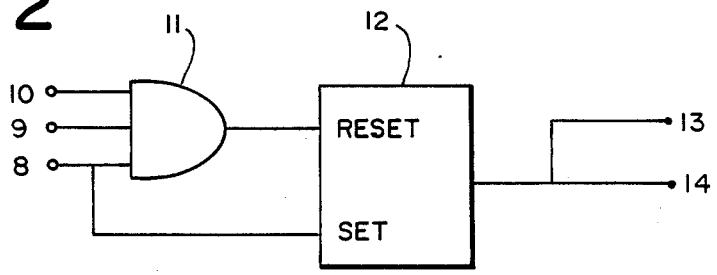
FIG. 2 shows a logic circuit for implementing the preferred embodiment.

As shown in FIG. 2, lines 8–10 are each electrically connected to an input of AND gate 11, located in the central controller 1. A logical "1" is output from the AND gate to the RESET input of a logic element 12 whenever the key-in-ignition, door-open, and manual-lock switches are simultaneously engaged. It will be recognized, of course, that any logic circuit gate combination or microprocessor "AND" instruction may be substituted for the illustrated AND gate, so long as it combines the signals from lines 8, 9, and 10 to output a signal in the described manner.

The output of logic element 12 is preferably a signal or pulse similar to the normal lock/unlock signals which activate the power door lock mechanism when switch 5 is pressed. For example, logic element 12 can be a flip-flop and the RS flip-flop SET input can be connected directly to line 8 so that the pulse output by the flip-flop corresponds exactly to the pulse or signal resulting from the closure of switch 5 to normally activate the power door lock mechanism 2. Alternatively, logic element 12 can be a one shot timer circuit such as the LM 555 timer produced by National Semiconductor and Texas Instruments. The use of this particular timer has the added benefit that the output signal duration on lines 13 and 14 can be adjusted by the election of a resistor-capacitor component. Typically, this time duration will be between 0.2 and 1.0 second to insure proper unlocking of the power door lock mechanism.

The output terminal of the element 12 is connected to both an alarm 3, via line 14, and to the unlocking circuit through line 13 as described above. Thus, when a pulse is output from element 12, the alarm will sound and the power door lock mechanism will be activated to unlock the door. Because of the three inputs into AND gate 11, this will only occur when the key-in-ignition and door-open conditions are satisfied, and when the door lock switch 5 is in contact with terminal A.

The operator lockout prevention system of the preferred embodiment shown in FIGS. 1–2 operates as follows:

When an ignition key is in the ignition, a signal from sensor 7 will be present at the input to AND gate 11 along line 10. When the operator subsequently attempts to leave his vehicle, and therefore opens the door, a signal from sensor 6 will be transmitted along line 9 to another input to AND gate 11. Finally, when the operator actuates switch 5, in order to lock the door, the locking circuit will be closed, the door will lock, and an electric signal will be transmitted along line 8 to AND gate 11. At this time, a logical "1" will be output by AND gate 11 to reset logic element 12. When switch 5 is released by the operator, after the door has been locked, the SET input to the element 12 will be triggered and the element will output a pulse along lines 13 and 14 to activate the unlocking mechanism and the alarm 3 such as the vehicles horn. The alarm sounds, warning the opertor that his door has been unlocked because the ignition key has been left in the ignition.

Figure 3:
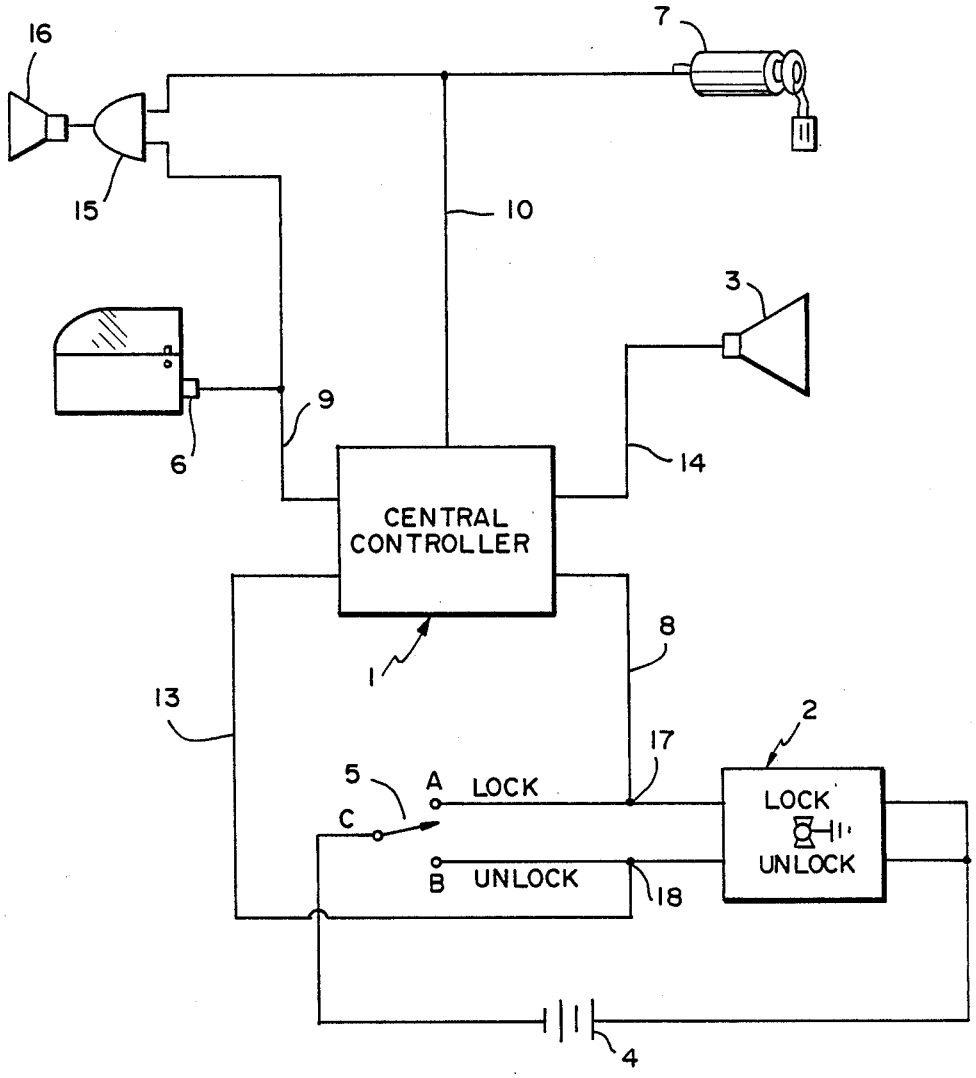
FIG. 3 shows a modification of the preferred embodiment of the invention.

A further advantageous modification of the invention is shown in FIG. 3, signal lines 9 and 10 may be connected to a logic circuit represented by AND gate 15 for controlling an alarm 16 which sounds whenever door-open and key-in-ignition conditions are simultaneously present, irrespective of whether the door has been locked. However, even if the operator ignores this warning and locks the door, the lockout prevention device of the invention insures that the key will not be locked in the vehicle.

Figure 4A:
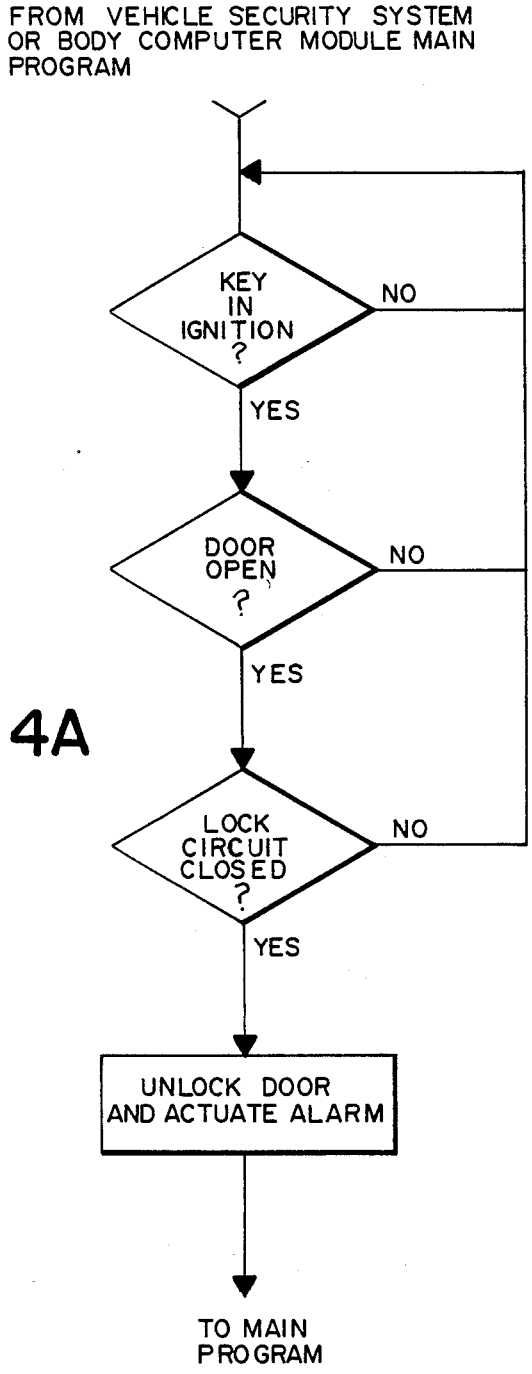
FIGS. 4A and 4B show flow charts for implementing the logic circuit via a microprocessor.
Figure 4B:
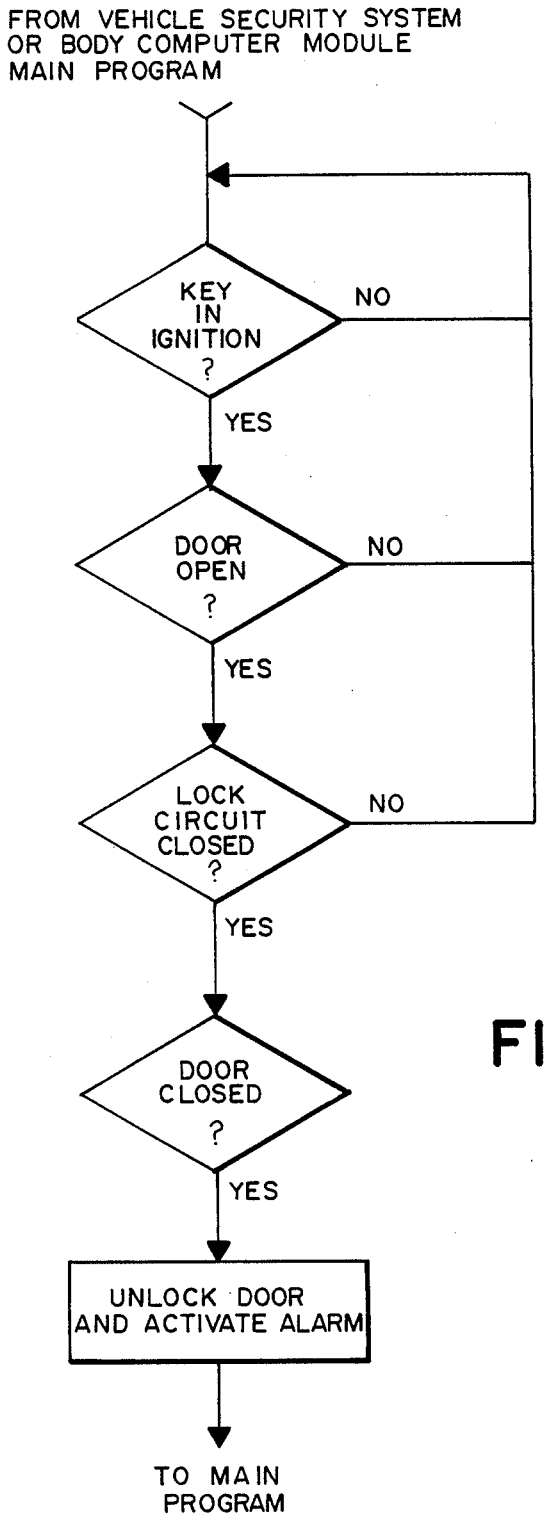

An especially advantageous feature of the preferred embodiment is that the logic circuit represented by AND gate 11 and logic element 12 may be included in the central controller of an existing vehicle security system or in a vehicle central control module used to control such functions as climate control, engine monitoring and/or the power door locks, sometimes referred to as a body computer module. To incorporate the logic circuit represented by AND gate 11 and logic element 12 in such a system, it is within the scope of the invention to simply reprogram an appropriately situated central microprocessor to include the functions represented by the logic circuit of this invention, as shown in FIGS. 4A and 4B. FIG. 4B differs from FIG. 4A by including a further step requiring that the central microprocessor determine that the driver's door has been closed before the system is activated to unlock the door and sound the alarm. This added program feature gives the vehicle operator a chance to discover his mistake before the door is closed and locked with the key in the ignition. Lines 8, 9, and 10 may be connected to existing lines from the central control module to the appropriate sensors. Line 14 may, for example, be an existing line from a central security system microprocessor to the security alarm or horn.

It will be appreciated that many other modifications and changes may be made by those skilled in the art without departing from the spirit of the invention. It is intended, therefore, by the appended claims to cover all such modifications and changes as fall within the true spirit and scope of the invention.

I claim:

1. In a motor vehicle including an ignition lock, a power door lock mechanism, first sensor means for generating a first electric signal when an ignition key is in said ignition lock, second sensor means for generating a second electric signal whan a door of the motor vehicle is open, and switch means movable from a lock position to an unlock position for causing said power door lock mechanism to selectively lock and unlock a lock for said door, said switch means closing a locking circuit when in said lock position and an unlocking circuit when in said unlocking position, the improvement comprising:

detection means for generating a locking signal when said locking circuit has been closed by said switch means;

a central controller including logic circuit means connected to each of said first and second sensor means, and to said detection means for generating a third electric signal whenever said first and second electric signals are simultaneously generated by said first and second sensor means, and said locking circuit is simultaneously closed; and means for transmitting said third electric signal to said unlocking circuit to cause said power door lock mechanism to unlock said door.

2. A system according to claim 1, further including an audible alarm generator connected to receive said third electric signal and to generate an audible alarm in response to said third electric signal.

3. A system according to claim 1, wherein said logic circuit means includes an AND gate and a logic element and wherein said first and second sensor means and said detection means are connected to inputs of said AND gate.

4. A system according to claim 3, wherein said logic element is a flip-flop.

5. A system according to claim 3, wherein said logic element is a one shot timer.

6. A system according to claim 1, wherein said logic circuit means is a microprocessor control program.

7. A system according to claim 1, further including a second audible alarm generator connected to said first and second sensor means for generating an audible alarm whenever said ignition key is in said ignition and said door is open, irrespective of the position of said switch means.

8. A system according to claim 1, wherein said central controller is included in a vehicle body computer module.

9. A system according to claim 1, wherein said central controller controls a car security system central controller.

10. A system according to claim 8, wherein said second sensor means generates an electric signal when the door of the vehicle is closed and wherein said vehicle body computer module delays sending said third electric signal until it receives the electric signal from said second sensor means indicating that the door is closed.

* * * * *